United States Patent [19]

Galey et al.

[11] 4,181,522

[45] Jan. 1, 1980

[54] METHOD OF RETARDING THE COOLING OF MOLTEN METAL

[75] Inventors: Jean Galey, Voisins Bretonneux; Gerard Bentz, Elancourt-Trappes; Pierre Karinthi, Joy-en-Josas; Ghislain Gilbert, Bures-sur-Yvette; Serge Devalois, Fourqueux, all of France

[73] Assignee: L'Air Liquide, Societe Anonyme pour l'Etude et l'Exploitation des Procedes Georges Claude, Paris, France

[21] Appl. No.: 871,981

[22] Filed: Jan. 23, 1978

Related U.S. Application Data

[62] Division of Ser. No. 592,077, Jun. 30, 1975, Pat. No. 4,093,553.

[30] Foreign Application Priority Data

Jul. 5, 1974 [FR] France ..... 74 23386

[51] Int. Cl.[2] ..... C22B 9/00

[52] U.S. Cl. ..... 75/96; 164/66; 252/70

[58] Field of Search ..... 75/96; 164/66; 252/70

[56] References Cited

U.S. PATENT DOCUMENTS

| | | | |
|---|---|---|---|
| 3,416,977 | 12/1968 | Rein | 148/20.6 |
| 3,868,987 | 3/1975 | Galey et al. | 75/96 |

*Primary Examiner*—M. J. Andrews

*Attorney, Agent, or Firm*—Young & Thompson

[57] ABSTRACT

The cooling of molten metal, such as metal continuously cast into an ingot mold, is retarded by establishing on the upper surface of the metal in the mold, a layer of cryogenic liquid such as nitrogen, helium or argon, with a finely divided material in homogeneous and stable suspension in the liquid. The finely divided material is in the form of particles having a size between 200 and 2,000 Å and is present in a quantity between 10 and 1,000 grams per liter of cryogenic liquid. The suspended material may be aluminum, titanium, zirconium, niobium, calcium, lithium, magnesium, solid glass, or an oxide of aluminum, titanium, zirconium, niobium, calcium, lithium or magnesium, and is highly reflective to infrared radiation from the metal so as to reduce the transparency of the cryogenic liquid to this infrared radiation.

1 Claim, 1 Drawing Figure

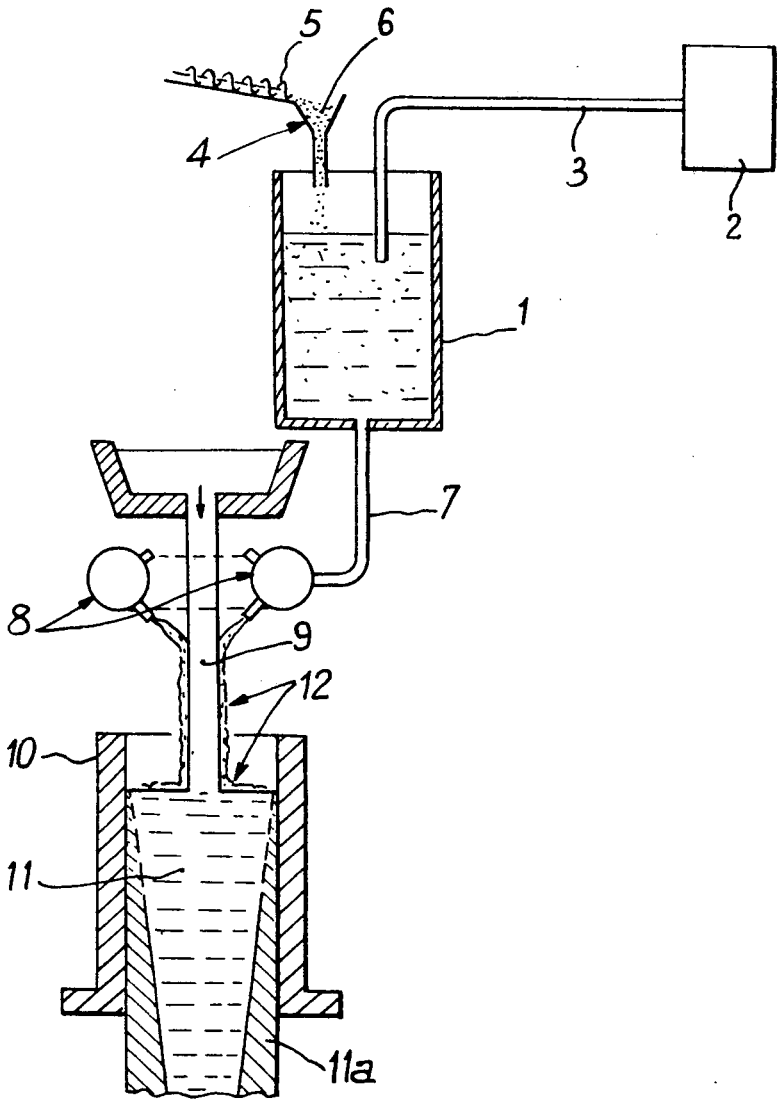
5
6
4
3
2
1
7
8
9
12
10
11
11a

METHOD OF RETARDING THE COOLING OF MOLTEN METAL

This application is a division of our copending application Ser. No. 592,077, filed June 30, 1975, now U.S. Pat. No. 4,093,553.

It is known to utilize certain liquefied inert gases such as nitrogen and argon for the protection of molten metal or alloys, by covering the free or exposed surface of the metal or alloy with a film of liquefied gas in order to isolate it from the atmosphere. As a result of the phenomenon of calefaction, there is formed in the film a gaseous lower layer in direct contact with the metal and a liquid upper layer superimposed on the said gaseous layer, this double layer ensuring the protection of the metal by eliminating all contact with oxygen or water vapor contained in atmospheric air, and in consequence preventing any possibility of chemical reaction likely to pollute the said metal.

While insulation with respect to atmospheric air is one of the conditions sought for, it is generally not the only one. In fact, it is frequently important, during continuous or non-continuous pouring, to limit the heat losses to the maximum extent, that is to say to limit the cooling of the metal in fusion.

Studies which have been carried out in these fields have shown that the use of known cryogenic fluids, in particular liquefied inert gases such as this was carried out up to the present time, did not make it possible to satisfy completely this condition.

These gases are in effect transparent to the radiation emitted by the metal at high temperature, so that this latter loses a substantial part of its heat and cools down relatively quickly.

Furthermore, it is known to utilize, for the cooling of metals, mixtures composed of a cryogenic fluid, for example liquid nitrogen, and of a divided solid additive having particle sizes greater than 5/100ths mm., and being as much as several millimeters. The function of these relatively large particles is to pass through the gaseous layer which is formed by calefaction on contact with the metal in such manner as to melt and absorb the latent heat of fusion.

This cooling technique excludes the utilization of too-fine particles, especially of particles less than 5/100ths mm., since they are conveyed through the gaseous space without reaching the metal, and in consequence the desired result cannot be obtained.

One of the objects of the present invention is generally to improve heat treatments utilizing cryogenic fluids by giving these fluids definite new properties which enable them to satisfy specific conditions required according to the nature of these treatments.

The invention has especially for its object to utilize compositions of materials formed by a cryogenic fluid and at least one additional constituent in the form of particles which, contrary to the compositions of this type at present known and contrary to liquefied gases utilized alone, reduce the radiation losses of the metal in fusion.

To this end there is proposed according to the invention the use of a composition of materials characterized in that it consists of at least one liquefied gas, at least one substance possessing intrinsically the definite properties referred to, this substance being present in the mixture in the form of particles having a sufficiently-small granular size, less than 50 microns, so as to form a homogeneous and stable suspension in the boiling liquefied gas.

Since these particles, due to their small size are in stable suspension in the liquefied gas, there is obtained a perfectly homogeneous composition having the same properties as the substance which it incorporates.

It can be seen that when the substance to be incorporated in the liquefied gas is present in the solid form at ambient temperature, the desired composition of material is obtained in a particularly simple manner.

The above-mentioned liquefied gas is preferably an inert gas such as nitrogen or helium, or alternatively a rare atmosphere gas such as argon.

The substance incorporated in the liquefied gas may be a substance having a high reflecting power for light and infrared radiation, for example a metal, a metallic oxide or a glass.

The invention is also directed to a method of treatment of molten metals utilizing the composition referred to, this method being characterized in that it consists of producing the above-mentioned mixture by utilizing an inert gas and covering the exposed surface of the metal with a layer of this mixture in order to isolate the said exposed surface from the atmosphere.

According to another characteristic feature of the method, there is incorporated in the inert gas a substance having a high reflecting power with respect to the radiation emitted by the metal, in order to reflect this radiation in the direction of the exposed surface referred to above.

In this case, the losses by radiation of the molten metal are reduced.

Other characteristic features and advantages of the invention will be brought out during the course of the description which follows below, reference being made to the accompanying drawing, given by way of example and without implied limitation, showing in a diagrammatic manner one form of embodiment of the invention applied to the continuous pouring of a metal.

Numerous tests have been carried out in the laboratory within the scope of the present invention, with a view to trying to produce finely-divided suspensions of powders in neutral gases. The tests made with the powders already utilized in order to obtain composition materials intended to facilitate the extraction of heat from a metallic object, have shown that these powders decant very rapidly or become agglomerated into lumps. On the other hand it has been found that by utilizing powders having a very small granular size, it was possible to obtain, especially in liquid nitrogen, extremely stable suspensions, that is to say which do not form any lumps and do not decant to an appreciable extent.

Tests have been carried out using metals, metallic oxides and glasses, that is to say silicates of calcium, sodium or other metals, these substances being utilized in the form of powders. These tests have shown that it was possible to obtain perfectly homogeneous and stable suspensions from powders having a very small granular size.

These various results have led to making systematic measurements of granular size and it has been found that the composition obtained had adequate stability characteristics when the particle sizes of the substance incorporated in the liquefied gas were less than 50 microns.

More accurate measurements made with metallic powders have shown that the optimum results were obtained with powders having a granular size of between 200 and 2000 Å.

The applications of the compositions of materials thus obtained, perfectly homogeneous and stable, to various metallurgical treatments have proved to be extremely satisfactory.

Tests made by employing metallic powders, metallic oxides or glasses in the liquid nitrogen and by using the compositions thus obtained for the protection of the exposed surfaces of molten metal, have shown that there was obtained, in addition to the protective effect referred to above with respect to the atmosphere, a very substantial reduction in the losses by radiation due to the fact that the light or infra-red rays emitted by the metal are reflected by particles in suspension in the direction of the metal itself and in consequence are not dispersed as a pure loss in the ambient atmosphere.

Metals which have given good results are aluminum, titanium, zirconium, niobium, calcium, magnesium and lithium and these metals can be used alone or in mixtures. Metallic oxides which have given good results are the oxides of these same metals used alone or in mixtures. The optimum concentrations in the case of metals, metallic oxides or glasses are comprised between 10 and 1,000 grams per liter of liquefied gas, and preferably between 20 and 100 grams per liter of liquefied gas.

Tests have also shown that the preparation of the suspension is extremely easy since it is only necessary to pour the appropriate quantity of powder into the liquefied gas, stirring being effected by the movements of convection due to the boiling of the gas. It is therefore not necessary to provide agitator devices or other more or less complicated apparatus in order to obtain a homogeneous mixture. The immediate result is that the mixture can be prepared just before the utilization of the composition of materials.

There has been shown in the accompanying drawing an example of the use of the invention applied to the protection of a molten metal in continuous pouring into an ingot-mold. There has been indicated at 1, for example a Dewar flask, into which liquid nitrogen is fed through a conduit 3, coming from a source 2 under pressure. Above the receptacle 1 is located a hopper 4 or the like supplied by an Archimedean screw 5 with powdered aluminum having a granular size of about 350 Å.

The powdered aluminum 6 falls directly from the hopper 4 into the liquefied gas contained in the receptacle 1 and mixes with this latter to give a homogeneous and stable suspension. The composition of materials thus obtained is fed, through the intermediary of an evacuation conduit 7 to a device 8 of known type, known as a "phase separator" which is provided to separate the gaseous phase from the liquid phase of the liquefied gas and to protect this latter on the jet 9, of molten metal which flows into the continuous-pouring ingot-mold 10.

The liquid layer 12 containing the aluminum in suspension which flows along the jet 9 and covers the upper surface of the mass of liquid metal 11 in the ingot-mold, effectively protects the free surfaces of the metal from the action of the atmosphere.

The liquid layer also practically prevents its cooling by reason of the reflection by the aluminum particles of the light and infra-red radiation emitted by the metal.

By the simple addition of a metallic powder to the liquid nitrogen, and utilizing a known apparatus, there is thus obtained a very considerable improvement in the conditions of continuous pouring of a metal.

By means of such a composition of materials formed by a mixture of liquid nitrogen and the suspended particles, it is of course possible to ensure the protection of free surfaces of molten metals in a stationary mass in the furnaces, ladles, molds or the like, or alternatively of the free surfaces in horizontal movement, for example of metal flowing in a spout.

What is claimed is:

1. A method of reducing heat loss from the upper surface of a body of molten metal, comprising establishing on said upper surface a layer of a cryogenic liquid selected from the group consisting of nitrogen, helium and argon, and suspending in said cryogenic liquid 10 to 1000 grams per liter of cryogenic liquid, of at least one finely divided material in the form of particles having a size between 200 and 2000 Å, said material being selected from the group consisting of aluminum, titanium, zirconium, niobium, calcium, lithium, magnesium, solid glass, and an oxide of aluminum, titanium, zirconium, niobium, calcium, lithium or magnesium, thereby to maintain a homogeneous and stable suspension of said material in said cryogenic liquid and to reflect infra-red radiation from said suspended particles back toward said molten metal.

* * * * *